US006142248A

United States Patent [19]

Thigpen et al.

[11] Patent Number: 6,142,248

[45] Date of Patent: Nov. 7, 2000

[54] REDUCED EROSION NOZZLE SYSTEM AND METHOD FOR THE USE OF DRILL BITS TO REDUCE EROSION

[75] Inventors: Gary Michael Thigpen, Houston; Henry P. Rebollido, Jr., Sugarland; Coy M. Fielder, Cypress; Brad Weston, Houston, all of Tex.

[73] Assignee: Diamond Products International, Inc., Houston, Tex.

[21] Appl. No.: 09/057,714

[22] Filed: Apr. 2, 1998

[51] Int. Cl.[7] ..... E21B 10/00; E21B 10/60

[52] U.S. Cl. ..... 175/340; 175/65; 175/339; 175/393; 175/424; 239/589

[58] Field of Search ..... 175/65, 67, 339, 175/340, 393, 424; 239/463, 489, 589, 600

[56] References Cited

U.S. PATENT DOCUMENTS

| | | | |
|---|---|---|---|
| 2,121,112 | 6/1938 | Zublin | 175/340 X |
| 2,408,892 | 10/1946 | Stokes | 175/393 |
| 3,542,142 | 11/1970 | Hasiba et al. | 175/424 X |
| 3,838,742 | 10/1974 | Juvkam-Wold | 175/393 X |
| 3,844,363 | 10/1974 | Williams, Jr. | 175/340 X |
| 3,876,253 | 4/1975 | Parker . | |
| 3,924,698 | 12/1975 | Juvkam-Word | 175/393 |
| 4,019,593 | 4/1977 | Craig . | |
| 4,082,015 | 4/1978 | Craig . | |
| 4,185,706 | 1/1980 | Baker, III et al. . | |
| 4,296,824 | 10/1981 | Kennington . | |
| 4,301,877 | 11/1981 | Cloud . | |
| 4,372,402 | 2/1983 | Trevino, Jr. . | |
| 4,378,853 | 4/1983 | Chia et al. . | |
| 4,381,825 | 5/1983 | Radtke . | |
| 4,392,534 | 7/1983 | Miida . | |
| 4,400,024 | 8/1983 | Ratcliff et al. . | |
| 4,407,378 | 10/1983 | Thomas . | |
| 4,427,221 | 1/1984 | Shay, Jr. . | |
| 4,494,618 | 1/1985 | Radtke . | |
| 4,516,642 | 5/1985 | Childers et al. . | |
| 4,527,642 | 7/1985 | Knowlton et al. . | |
| 4,542,798 | 9/1985 | Madigan . | |
| 4,546,837 | 10/1985 | Childers et al. . | |
| 4,558,754 | 12/1985 | Childers et al. . | |
| 4,567,954 | 2/1986 | Voight, III et al. . | |
| 4,582,149 | 4/1986 | Slaughter, Jr. . | |
| 4,603,750 | 8/1986 | Sorenson . | |
| 4,611,673 | 9/1986 | Childers et al. . | |
| 4,665,999 | 5/1987 | Shoemaker . | |
| 4,685,359 | 8/1987 | Worthen et al. . | |
| 4,687,067 | 8/1987 | Smith et al. . | |
| 4,694,919 | 9/1987 | Barr . | |
| 4,703,814 | 11/1987 | Nguyen . | |
| 4,711,311 | 12/1987 | Underwood . | |
| 4,741,406 | 5/1988 | Deane et al. . | |
| 4,759,415 | 7/1988 | Pessier . | |
| 4,776,412 | 10/1988 | Thompson . | |
| 4,784,231 | 11/1988 | Higgins . | |
| 4,848,476 | 7/1989 | Deane et al. . | |
| 4,878,548 | 11/1989 | Ostertag et al. . | |
| 5,029,656 | 7/1991 | Ivie et al. . | |
| 5,072,796 | 12/1991 | Shen et al. . | |
| 5,494,122 | 2/1996 | Larsen et al. . | |
| 5,538,093 | 7/1996 | Siracki et al. . | |
| 5,669,459 | 9/1997 | Larsen et al. | 175/340 |

*Primary Examiner*—Eileen D. Lillis
*Assistant Examiner*—Jong-Suk Lee
*Attorney, Agent, or Firm*—Sankey & Luck, L.L.P.

[57] ABSTRACT

Subterranean drill bits and particularly to nozzle features to be incorporated in subterranean bits. In one embodiment, the nozzle assembly of the invention defines a wear resistant structure which extends upstream from the terminus of the transition area. In another embodiment, nozzle assemblies are arranged about the transition area at low angles so as to minimize flow turbulence.

18 Claims, 9 Drawing Sheets

REDUCED EROSION NOZZLE SYSTEM AND METHOD FOR THE USE OF DRILL BITS TO REDUCE EROSION

BACKGROUND OF THE INVENTION

1. Field of the Invention

The present invention generally relates to a nozzle system for a downhole drill bit. More particularly, the present invention relates to an improved drill bit and nozzle system which better manages fluid flow and decreases erosion of the drill bit body and methods for the design and operation of downhole drill bits to reduce erosion.

2. Description of the Prior Art

Subterranean drill bits are used in a number of different applications and under a variety of environments. In this connection, subterranean drill bits are conventionally used in mining, construction, oil and gas exploration, and oil and gas production.

There are two general types of commercially available drill bits. A roller bit utilizes steel teeth or tungsten carbide inserts. A fixed cutter bit describes a drill bit that does not employ a moving cutting structure. Fixed cutter bits include polycrystalline diamond compact (PDC), thermally stable polycrystalline (TSP), natural diamond and other bits which do not use a diamond material as a cutting element.

A conventional downhole drill bit includes a shank with a threaded connection for mating with a drilling motor or a drill string. The shank can include a pair of wrench flats, sometimes referred to as "breaker slots", to apply the appropriate torque to make-up the thread shank. The distal or bottom end of the drill bit contains the cutting structure, be it roller or fixed cutter as described above. The bit body further includes a central bore which allows fluid communication between the borehole and the drill string. This central bore terminates in several fluid openings disposed about the bit face and adapted to circulate pressurized fluid over the cutting surface. These openings are provided with nozzles which control fluid flow therethrough.

By utilizing a small nozzle orifice in the nozzle body, fluid velocity through the central bore is increased with a proportionate increase in the pressure required to pump a given volume of fluid. Conversely, by increasing the nozzle orifice, the pressure to pump a given volume of fluid decreases and the fluid velocity decreases. By selecting the nozzle orifice size, the operator is able to control the velocity and pressure of the fluid flow through the bit.

Internal erosion in and around nozzle bodies is a major problem in the longitivity of the bit and, indirectly, the economy of the drilling operation. Drilling fluid generally contains a percentage of entrained solids, many of which are highly abrasive. Given the presence of such entrained solids, increased fluid velocity generally results in a proportionate increase in the erosion of the bit body. Consequences of such erosion include eroded areas through the bit structures which result in a loss of hydraulic pressure and necessitates a trip out of the bore hole to replace a bit damaged as a result of fluid erosion.

There are a number of disadvantages associated with traditional subterranean drill bits and methods for their operation. One such disadvantage relates to internal erosion of the drill bit body caused during operation of the bit by fluid circulation. Factors contributing to such erosion include mud weight, mud viscosity and flow velocity through the drill bit.

A second disadvantage is internal erosion of the drill bit body caused by geometrical discontinuities in the fluid openings leading to the nozzle bodies. In this connection, sharp angles create fluid flow separation and high shear layer stresses as well as adding to the erosive capabilities of the fluid.

Other disadvantages lie in the method of operation of traditional drill bits. Conventional methods of operation given known design parameters fail to maintain laminar fluid flow within the bit body during operation, thereby resulting in enhanced erosion.

SUMMARY OF THE INVENTION

The present invention addresses the above identified and other disadvantages or prior art drill bit nozzle systems and methods for their use.

In one embodiment, the drill bit of the present invention comprises a drill bit body defining a pin end and a cutting end. The bit body further defines a bore therethrough which is open at both the pin and the cutting ends so as to provide for fluid communication between the bore and the borehole. The bore terminates in a counterbore or plenum which creates an angled transition area and a smaller area entrance to the nozzle. The nozzle itself generally describes an elongate cone which terminates in a flow restriction of a variable diameter.

In one preferred embodiment, the nozzle assembly of the present invention defines a structure which protrudes a selected distance upstream from the terminus of the transition area. In such a fashion, any turbulence created through fluid flow in the bore is transitioned from the terminus to an intermediate area. Hence, erosion of the bit body is significantly reduced.

In another embodiment, the nozzle assemblies are arranged about the transition area at low enough angles incident to fluid flow so as to minimize turbulence given other operational parameters.

Another embodiment of the invention defines an operational regime which selectively contemplates those factors contributing to reduced erosion of the bit body. In such a fashion, turbulent flow within the counterbore is avoided, thereby prolonging the life of the drill bit.

The present invention achieves a number of benefits over prior art drill bit nozzle systems. One such advantage is the reduction of the erosion of the bit body as a result of the substantial reduction of turbulent flow in the nozzle bore.

Another advantage presented by the drill bit of the present invention includes a nozzle structure adapted to transition what turbulence is created in the bore to areas of the bit body not as prone to erosion.

Still other benefits and advantages of the invention will become obvious in light of the following description of the preferred embodiment and the accompanying drawings.

DETAILED DESCRIPTION OF THE PREFERRED EMBODIMENT

Figure 1:
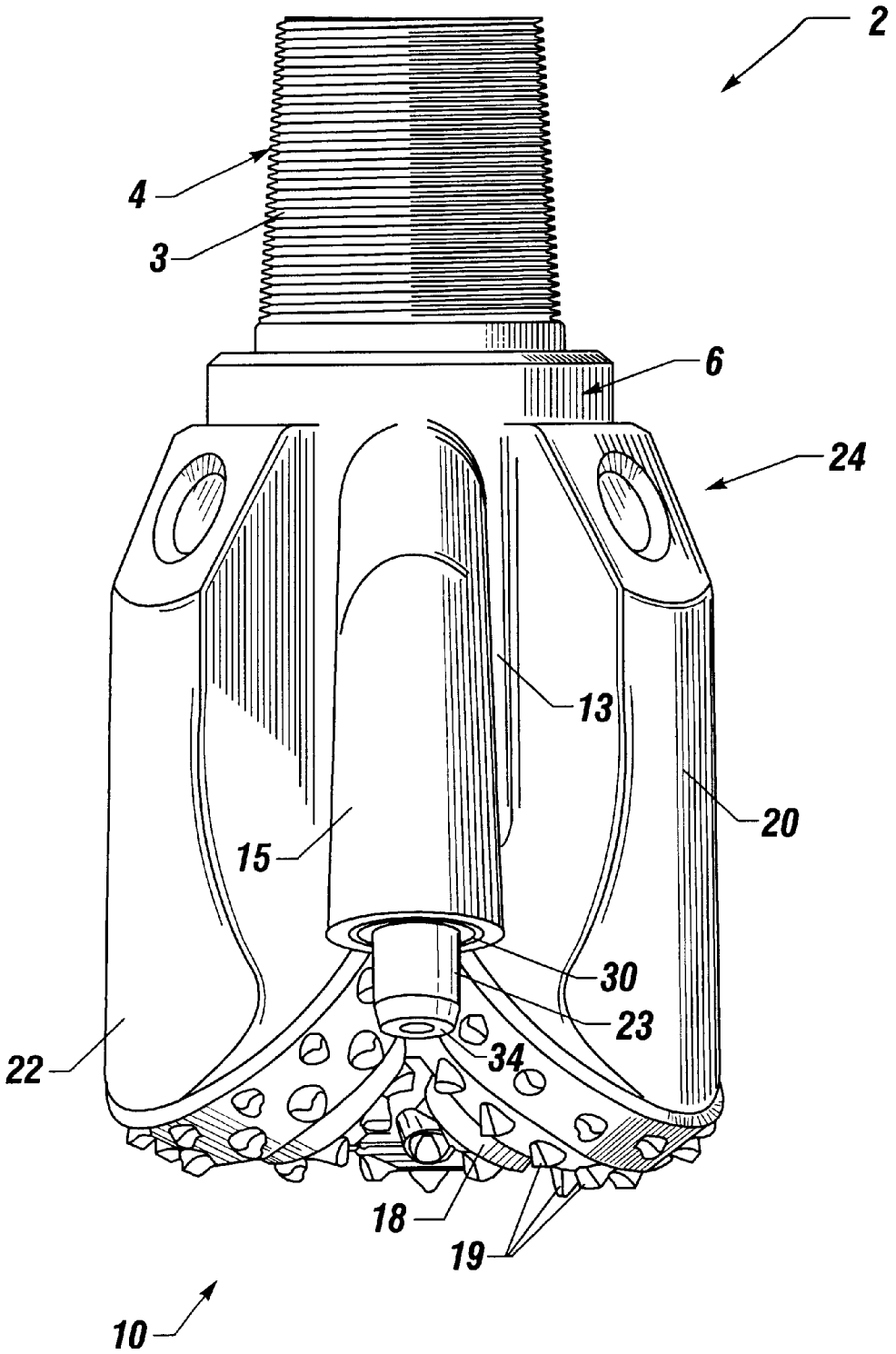
FIG. 1 (PRIOR ART)
FIG. 1 illustrates a side view of a conventional, rotary cone bit.

It is well known that erosion of downhole tools is a function of a number of factors. One of the most significant of these factors is the existence of turbulent, as opposed to laminar, drilling fluid flow in the plenum of the bit.

Turbulent flow is generally considered to exist when conditions in the bore define a Reynolds number in excess of a dimensionless figure of 4000. Laminar flow is generally defined as those conditions below 2000. Between a Reynolds numbers of 2000 and 4000 the flow pattern is in transition, and can demonstrate either or both laminar or turbulent tendencies.

The Reynolds number Re is defined as a result of the following equation for flow inside a tube $$Re = \frac{15.47\, pvD_F}{\mu} \tag{1}$$

Where p equals mud weight expressed in pounds per gallon, v equals annular velocity as expressed in feet per minute, $D_F$ equals the inlet diameter of the nozzle in inches, and $\mu$ equals viscosity as measured in centipoise. The viscosity of the drilling fluid is a function of the types and quantities of additives, the temperature of the mud, and the volume of the entrained solids.

The flow rate necessary to maintain a given bit in a non turbulent, and hence a reduced erosion, operating regime can be calculated given a knowledge of the aggregate nozzle inlet diameter $\Sigma D_p$, the mud weight p and the viscosity $\mu$, where the goal is to maintain operation of the tool below a transition Reynolds value of 2300. Thus where $$R_E = \frac{15.47\, pv\Sigma D_P}{\mu} \tag{1}$$

$$R_E\mu = 15.47\, pv\Sigma D_p \tag{2}$$

or $$\frac{Re\mu}{15.47\, p\Sigma D_p} = v \tag{3}$$

Thus, where mud viscosity, mud weight and total inlet diameters are known, non turbulent operation of the tool may be maintained as a function of the velocity of the drilling fluid as measured at the nozzle inlets. This may be observed by reference to the following example:

EXAMPLE 1

Drillstring

Drill collars 90 ft. of 6¼ in O.D. 2¾ ID

Heavyweight pipe 1500 ft. 4½ in O.D., 3 in 1D

Drillpipe 10,410 ft. 4½ in. O.D., 3.82 ID

Bit 3½ nozzles (X 3)

Mud Properties at 120° F.

Weight=15 lb/gal

Filtrates Weight: 20 cc@300° F.

Viscosity 80

Inserting a Reynolds value of 2300 in equation (3) permits the calculation of a non erosional fluid velocity:

$$v = \frac{2300\,(80)}{15.47\,(15\text{ lb/gal})(3\times 3.5)} = 75.51\text{ ff/min}$$

Hence, to observe laminar flow for a drill bit operating under the foregoing conditions, a flow rate of 75.5 ff/min may not be exceeded.

The above example assumes no turbulence created as a result of the angulation of the nozzles vis a vis the axis defined by the bore. However, applicant has discovered that even at flow parameters producing a Reynolds number at or below 2300, significant erosion still occurs as a result of geometrical discontinuities of the nozzles vis-a-vis the longitudinal axis of the drill string.

There is no single value for which a fluid flow regime can be predicted to be turbulent, a general value is known to be 2300. However, flow can be turbulent at values less than 2000 and flow can be laminar at values greater than 4000. There are factors not reflected in the Reynolds number such as flow regime at the fluid inlet, surface roughness at the flow boundary, external forces to excite the flow.

For fluid flow in the inlet of the nozzles one factor is the angle of the nozzle to the fluid flow direction at the nozzle entry. Changes of fluid flow direction lower the value of Reynolds number at which turbulent flow can be expected. If the nozzle direction is aligned with the fluid flow direction, then the fluid does not have to change direction to pass through the nozzle. As the angle of the nozzle increases, flow becomes turbulent at lower Reynolds numbers.

Notwithstanding the aforereferenced methodology to reduce erosion in a conventional drill string, erosional damage nevertheless does occur. Applicant has thus developed a drill bit which incorporates nozzle structures to reduce erosional damage.

Figure 2:
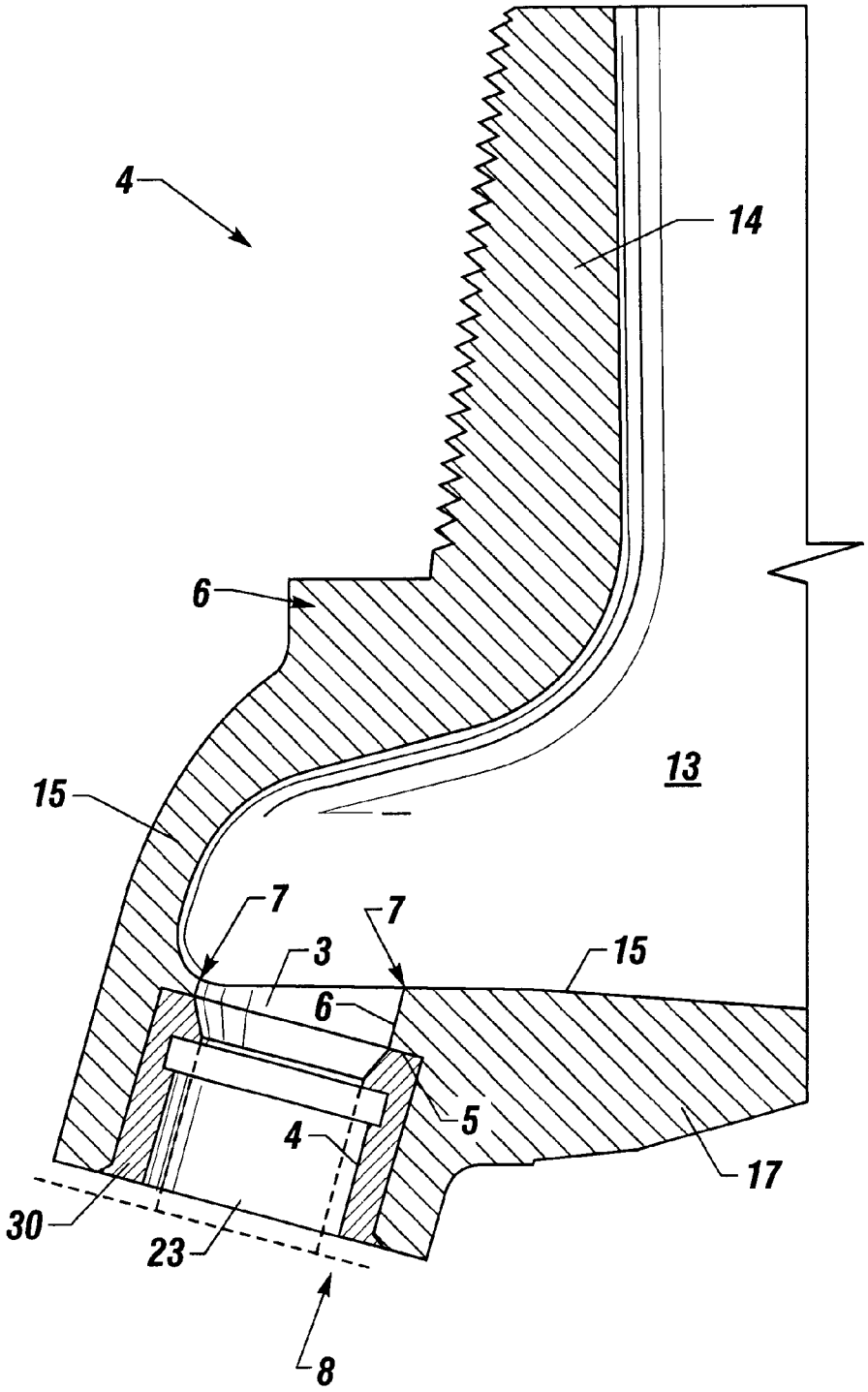
FIG. 2 (PRIOR ART)
FIG. 2 illustrates a partial cross, sectional view of a conventional bit and nozzle system.

A contemporary drill bit 2 may be seen by reference to FIGS. 1 and 2 in which are illustrated a pin end 4 defining a threaded shank 3, a bit body 6 and a cutting end 10. By reference to FIG. 2, a fluid chamber or plenum 13 is formed within bit body 6 and communicates with the open pin end 4 so that hydraulic fluid (drilling mud) may enter said body 6 though an attached drill string (not shown) and exit through nozzles 23.

A dome 17 formed by the bit body 6 defines a portion of the terminal end 15 of fluid plenum 13. Bit legs 20 extend from said bit body 6 toward the cutting end 10 of said bit 2. (See FIG. 1) A cutter cone 18 is rotatively secured to each leg 20 through a journal bearing (not shown) extending into each cone from a shirttail 22 of leg 20. As illustrated, each cone 18 includes a plurality of spaced, cutter inserts 19.

In the illustrated embodiment, a nozzle 23 extends from a nozzle retention sleeve generally designated at 30. A counterbore 3 is drilled into plenum 13 followed by second counterbore 4 which terminates at a shoulder 5 formed in nozzle retention body 30. The plenum entrance to straight bore 3 creates a sharp corner 7 as well as a reduced-in-area entrance to standard nozzle sleeve generally designated at 8. This reduced diameter entrance increases mud flow velocities into the entrance of nozzle sleeve 8, thus accelerating any erosion of the bit body which may there occur.

Figure 3:
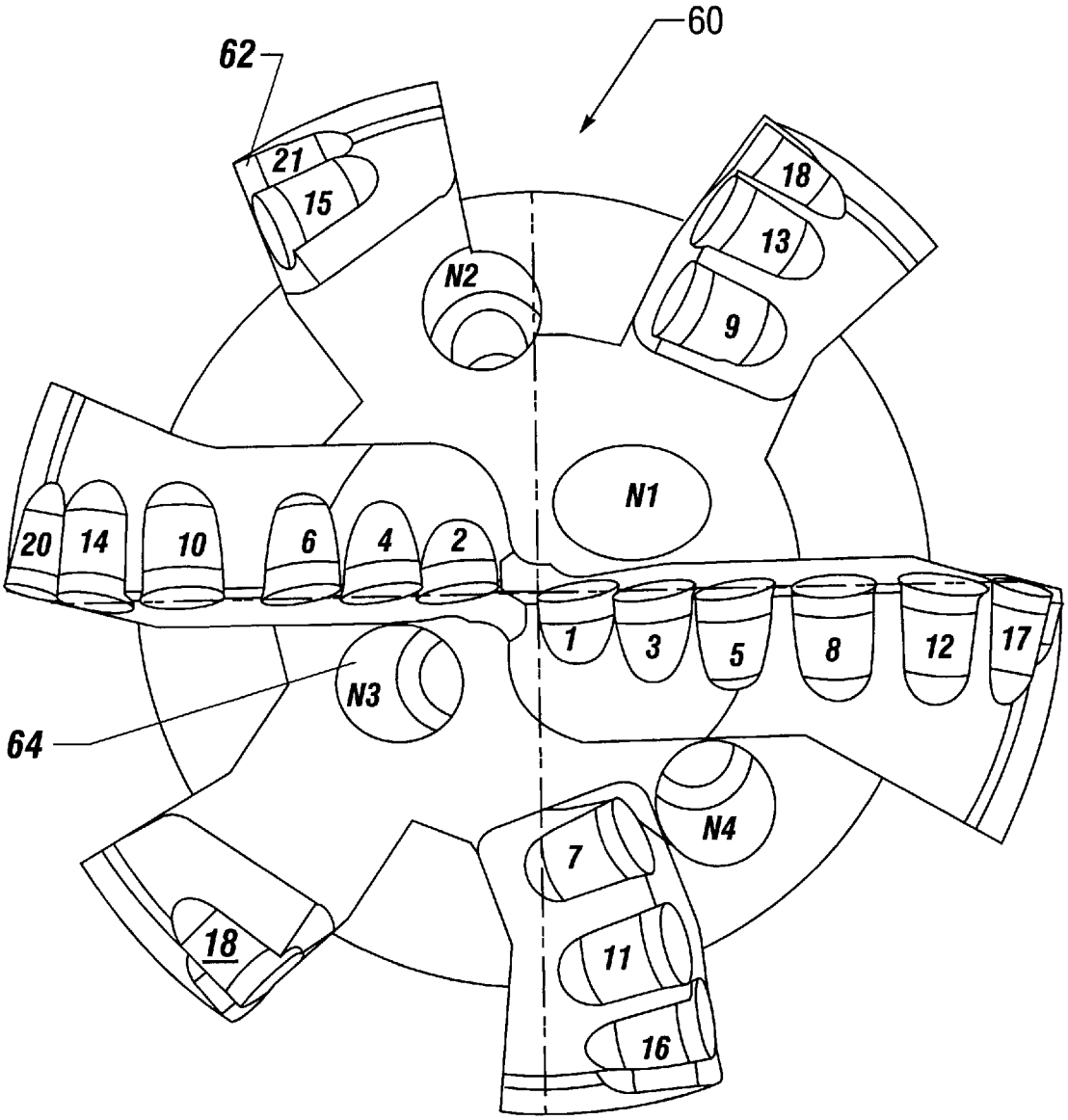
FIG. 3 (PRIOR ART)
FIG. 3 illustrates a bottom or face view of a conventional bit.
Figure 4:
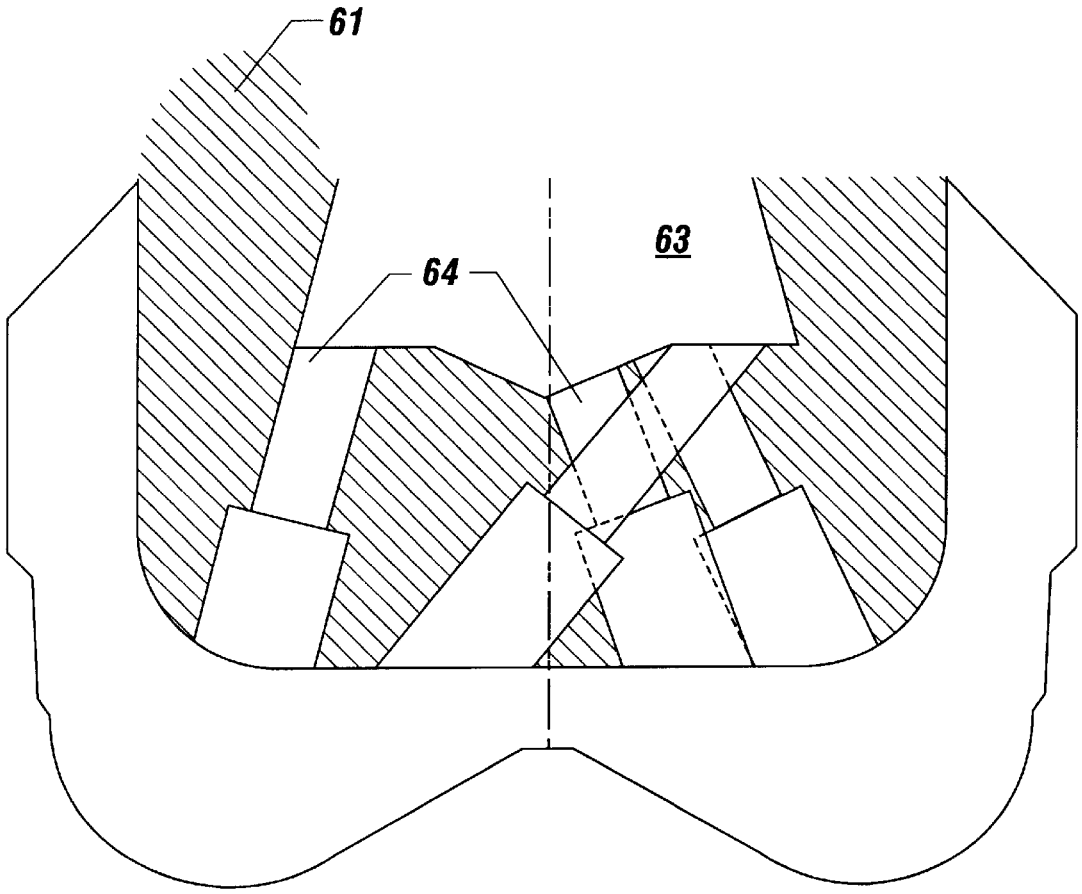
FIG. 4 (PRIOR ART)
FIG. 4 illustrates a fragmentary, cross sectional view of a conventional bit illustrating nozzle configuration and placement.
Figure 5:
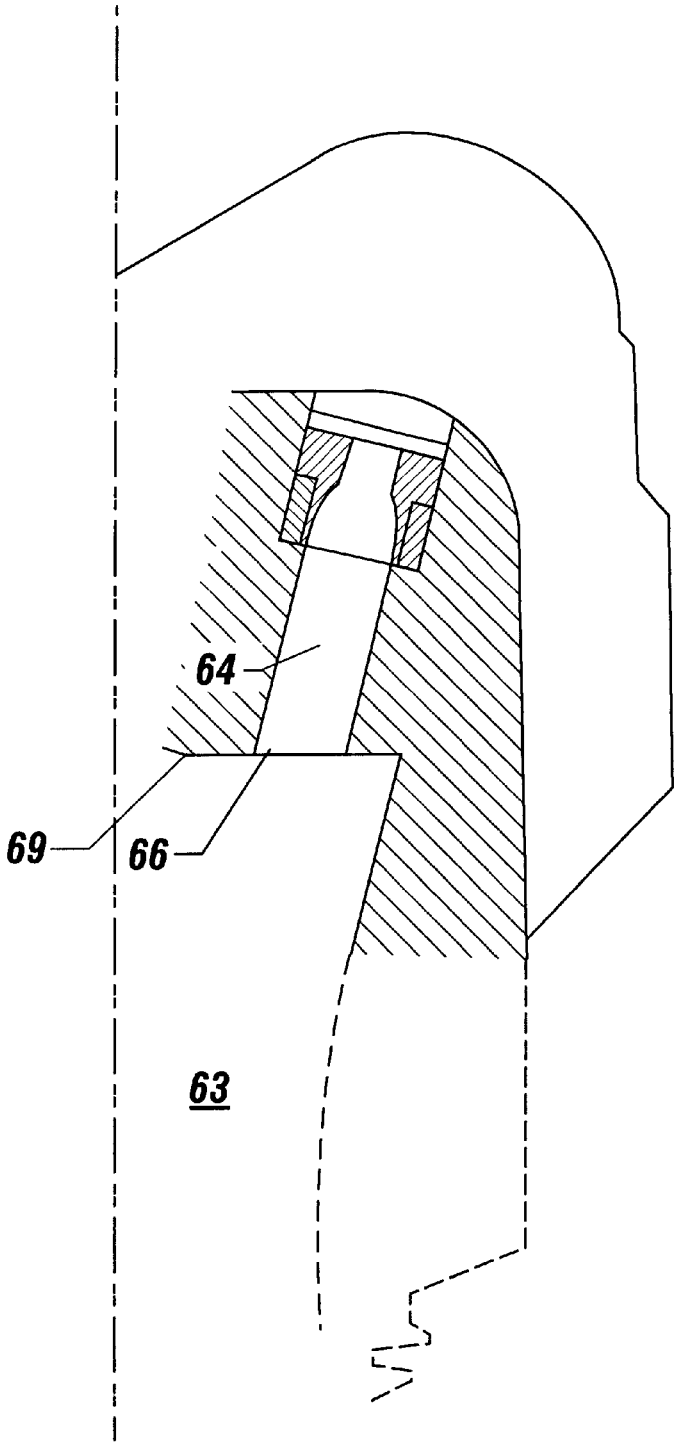
FIG. 5 (PRIOR ART)
FIG. 5 illustrates a fragmentary, detail cross sectional view of a conventional nozzle system.

FIG. 3 illustrates the bottom or cutting end 60 of a fixed cutter bit incorporating cutters 62 and a series of nozzles 64 which perform in a similar fashion to those described above in association with a rotating drill bit. A cross sectional view of the nozzle system employed in association with the fixed cutter bit illustrated in FIG. 3 may be seen by reference to FIG. 4 which illustrates a bit body 61, a plenum 63 and nozzles 64. As illustrated in FIG. 4 and in more detail in FIGS. 5 and 6, the nozzles incorporated in these prior art bits are also situated such that their throat 66 is formed flush with the terminal end 69 of the plenum chamber 63.

Figure 6:
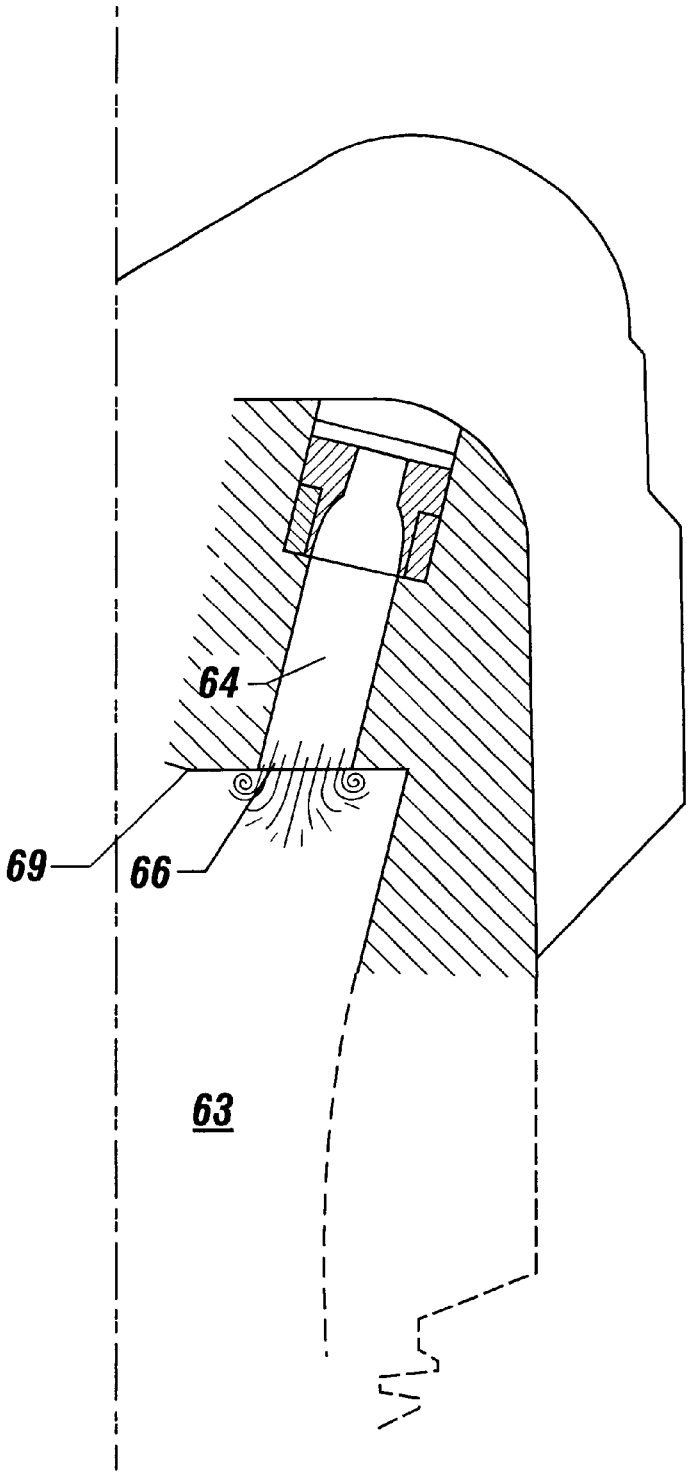
FIG. 6 (PRIOR ART)
FIG. 6 illustrates the nozzle system illustrated in FIG. 5 with the turbulence streams marked.

As illustrated in FIG. 6, this configuration precipitates and/or exacerbates turbulence about the edge of said throat 66, thereby leading to erosion of the bit body. Such erosion over time forces an independent fluid passageway from the plenum 63 to the bit face 60, thereby resulting in the destruction of nozzle 64.

Figure 7:
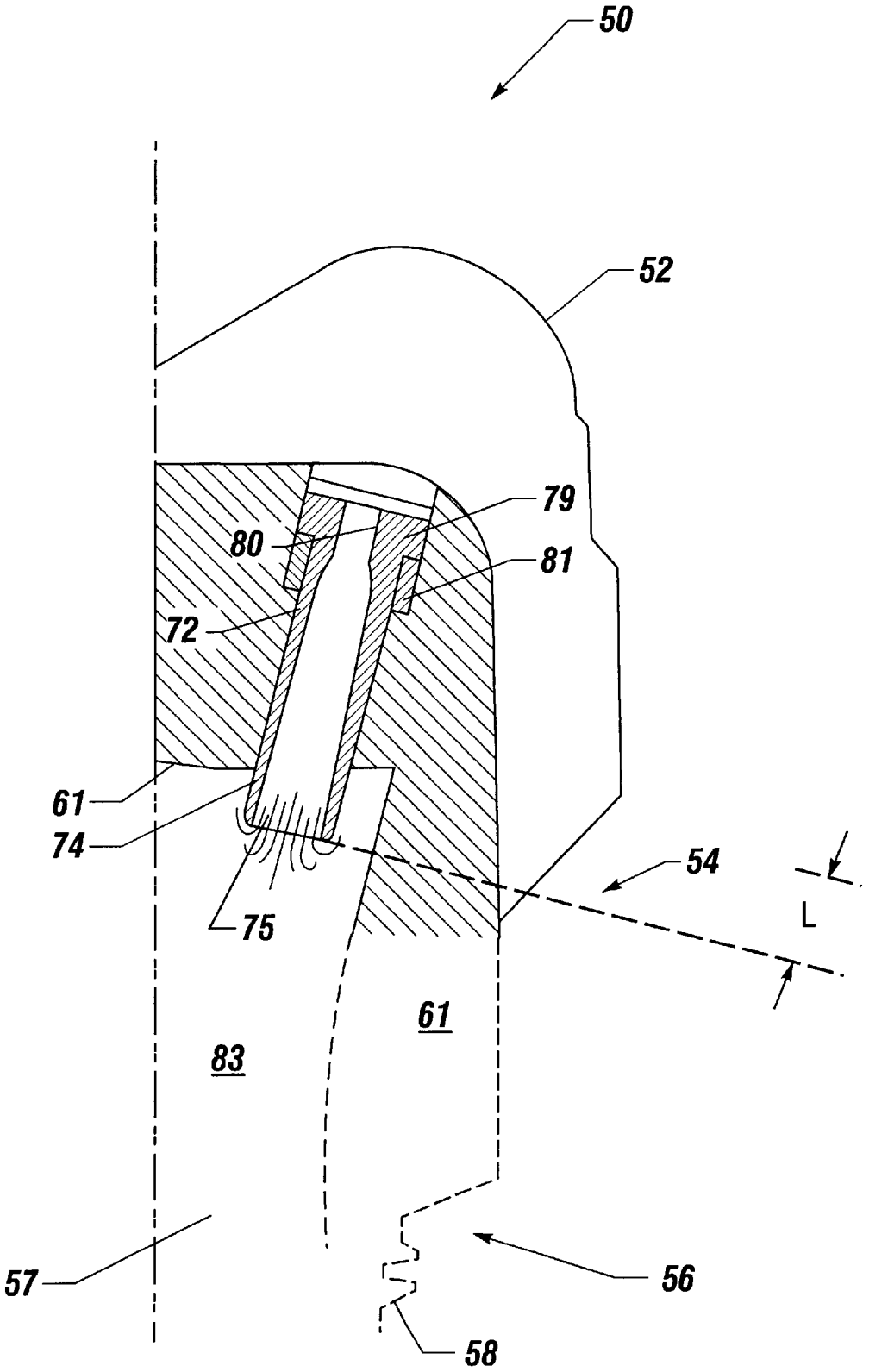
FIG. 7 illustrates a fragmentary, cross sectional view of one embodiment of the present invention.
Figure 8:
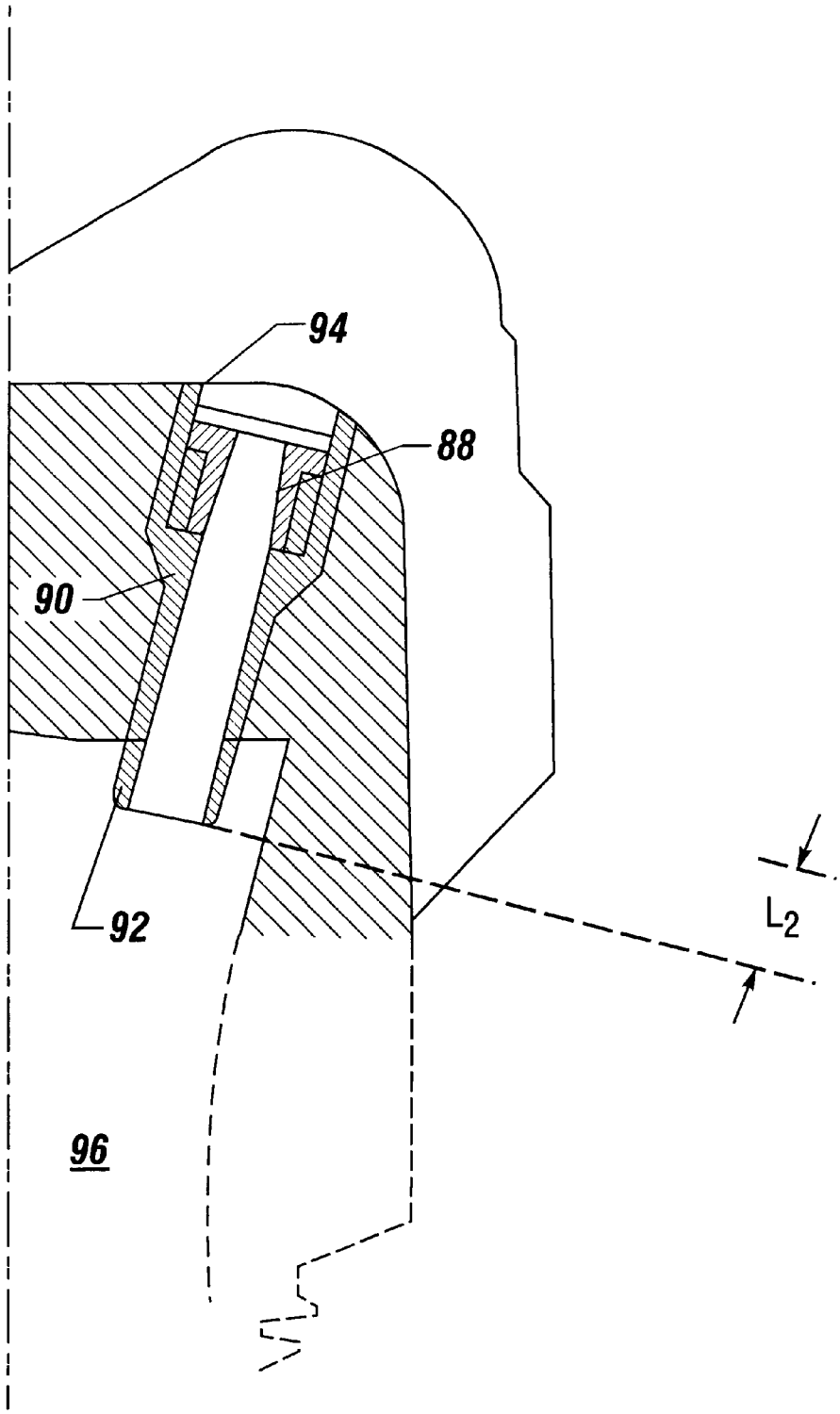
FIG. 8 illustrates a fragmentary, cross sectional view of a second embodiment of the present invention.
Figure 9:
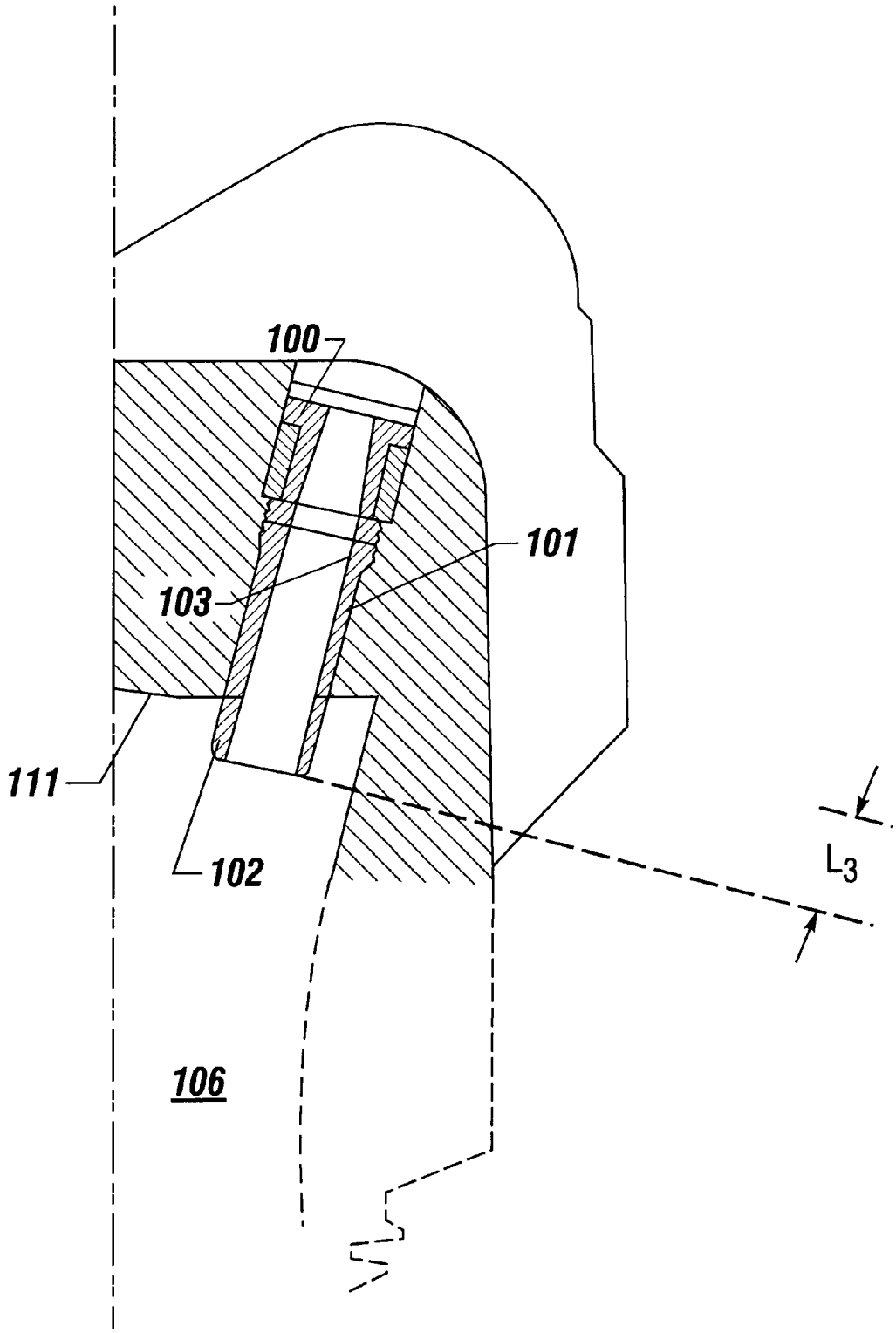
FIG. 9 illustrates a fragmentary, cross sectional view of a third embodiment of the present invention.

Several embodiments of the nozzle assembly of the present invention may be seen by reference to FIGS. 7–9. FIG. 7 illustrates a fragmentary, cross sectional view of a drilling bit 50 defining a bit face 52, a bit body 54 and a pin end 56 including a threaded shank 58. Bit body 54 defines a bore 57 which terminates in a plenum chamber 80 and a nozzle.

The nozzle assembly of the present invention may adopt a variety of configurations. In the embodiment illustrated in FIG. 7, nozzle assembly 70 includes an integral nozzle body 72 which includes an upstream, proximal end 74 defining a throat 75 and a distal end 79 which is threadedly engagable with a liner 81 which may be brazed or welded into bit body 54 in a conventional fashion. In the embodiment illustrated in FIG. 7, throat 75 terminates in a constricted neck region 80. Throat 75 forms a fluid flow path from plenum chamber 83 to the constricted neck region 80. The restrictions in the neck 80 converts the potential energy of the fluid at high pressure and low velocity to kinetic energy.

As illustrated in FIG. 7, the upstream, proximal end 74 of nozzle assembly 70 is raised above the terminal end 61 of plenum chamber 83. In such a fashion, any turbulence in the drilling fluid created around proximal end 74 does not erode the bit body 61 but instead acts solely on the proximal end 74 of the nozzle body 61 which is preferably manufactured from an erosion resistant material, e.g. tungsten carbide.

In a preferred embodiment, proximal end 74 is raised a distance "L" above said terminal end 61, where "L" is preferably in a range of one eighth (⅛") to one half (½") inch in length.

A second embodiment of the nozzle system of the present invention may be seen by reference to FIG. 8. In FIG. 8, nozzle assembly 88 threadedly receives a liner 90 which itself defines an upstream, proximal end 92 and a distal end 94, where said proximal end 92 of liner 90 is carried above the terminus of plenum chamber 96 a distance "$L_2$", where $L_2$ is in the range of ⅛"–½" in length. In this embodiment, liner 90 is preferably comprised of a hard, erosion resistant compound such as tungsten carbide.

Yet a third embodiment of the nozzle assembly of the present invention may be seen by reference to FIG. 9. In FIG. 9, a conventional nozzle 100 is seated on a liner 101, where the liner 101 defines an upstream or proximal end 102 and a distal end 103. As with prior embodiments, the proximal end of liner 101 is formed above the terminus 111 of plenum chamber 106 a distance $L_3$, where $L_3$ is in the range of ⅛"–½" in length.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. An erosion resistant nozzle system for earth boring rock bits comprising:

a rock bit body, said body forming a first pin end, a second cutting end and defining a longitudinal axis, said body further defining an interior cavity that communicates with the interior of a drill string that is attachable to said first pin end of said rock bit body, where further said body forms at least one nozzle cavity for directing fluid therethrough from an upstream to a downstream direction, where said nozzle cavity defines a terminal end;

a nozzle assembly including a nozzle body and a liner where both define a bore therethrough, an inlet end and an outlet end where said nozzle cavity defines a flow restriction toward said terminal end, where said nozzle assembly is secured within said rock bit body at the terminal end of said nozzle cavity; and said liner disposed a distance L from the terminal end of said nozzle cavity so as to define any turbulence zones upstream from said terminal end of said nozzle cavity.

2. The nozzle system of claim 1 where said liner is comprised of an erosion resistant material.

3. The nozzle system of claim 2 where said liner is comprised of tungsten carbide.

4. The nozzle system of claim 1 where said distance L is between ¼ and ½ inches.

5. A method to resist erosion of a fluid nozzle for earth boring rock bits comprising the steps of:

forming a rock bit body, said body forming a first pin end and a second cutting end, said body further forming an interior cavity that communicates with the interior of a drill string, said body defining at least one nozzle cavity for directing fluid therethrough, where said nozzle cavity defines an upstream and a terminal end;

forming a nozzle assembly that is adapted for being inserted within said nozzle cavity, where said nozzle assembly includes a nozzle body and exterior liner where both the nozzle and the liner define a bore having an inlet end and an outlet end, said nozzle assembly being secured in the bit body, where said inlet end of said liner is displaced upstream from said terminal end a distance sufficient to displace turbulence in said fluid upstream from said terminal end of said nozzle cavity and is at least partially formed of an erosion resistant material, where said nozzle cavity defines a flow restriction toward the terminal end.

6. The method as forth in claim 5 further comprising the step of forming said nozzle body from an upstream and a downstream component, where said upstream and downstream components are coupled together to form a bore therethrough.

7. The method as set forth in claim 6 further comprising the step of forming said bore to define a constriction at the outlet end of said nozzle body.

8. The method as set forth in claim 6 further comprising the steps of forming the upstream component of an erosion resistant material.

9. The method as set forth in claim 8 where said material is tungsten carbide.

10. The method of claim 6 further including the steps of forming the bore entirely within the upstream component, coupling the upstream component to the downstream component and securing the combination to the rock bit body.

11. The method as set forth in claim 10 further including the step of securing said upstream and downstream components by brazing.

12. The method as set forth in claim 5 where said displacement distance is between ¼ and ½ inches.

13. A nozzle assembly for an earth boring drill bit of the type comprising a bit body having a threaded pin at an upper end of the bit body adapted to be detachably secured to a drill string and passageways therein for receiving drilling fluid under pressure from the drill string extending from an opening in the pin down to a nozzle bore in a lower end of the bit positioned closely adjacent to the well bore bottom when the bit is in engagement therewith for the exit of the drilling fluid from the bit, where said nozzle bore defines a terminal end, said nozzle assembly comprising:

a generally cylindrical nozzle assembly including a nozzle member and a liner formed of an abrasion and erosion resistant material, where said nozzle member and said liner define a bore therethrough of varying cross sections and an inlet and an outlet end, said bore extending along the central longitudinal axis of the nozzle assembly and forming a flow restriction at said outlet end, the nozzle member and the liner being adapted to be fitted in the inner portion of the nozzle bore, where the inlet end of said line is displaced upstream a distance L from the terminal end of the nozzle bore so as to displace any turbulent flow area upstream from said terminal end.

14. The nozzle assembly of claim 13 where in the abrasion and erosion resistant material of the nozzle member is tungsten carbide.

15. The nozzle assembly of claim 13 wherein the nozzle member is comprised of a liner element and a receiving body coupled to said liner element where the combination of the liner element and the receiving body is welded to the bit body.

16. The nozzle assembly of claim 15 where said liner is threaded into the receiving body.

17. The nozzle assembly of claim 15 where said liner extends into the nozzle bore.

18. The nozzle assembly of claim 13 where said displacement distance "L" is between ¼–½ inches.

* * * * *